US008434756B2

(12) United States Patent
Brewer

(10) Patent No.: US 8,434,756 B2
(45) Date of Patent: May 7, 2013

(54) CONFORMING PAPER TRAY PLATE FOR LARGE FORMAT PAPERS HAVING ATTACHED ID CARDS

(75) Inventor: Charles Raymond Brewer, Farmington, NY (US)

(73) Assignee: Xerox Corporation, Norwalk, CT (US)

( * ) Notice: Subject to any disclaimer, the term of this patent is extended or adjusted under 35 U.S.C. 154(b) by 353 days.

(21) Appl. No.: 12/769,828

(22) Filed: Apr. 29, 2010

(65) Prior Publication Data

US 2011/0268552 A1 Nov. 3, 2011

(51) Int. Cl.
*B65H 1/08* (2006.01)

(52) U.S. Cl.
USPC ..... 271/148; 271/160; 414/925

(58) Field of Classification Search ..... 271/148, 271/219, 218, 160; 414/796.7, 925; 108/91
See application file for complete search history.

(56) References Cited

U.S. PATENT DOCUMENTS

| | | | | | |
|---|---|---|---|---|---|
| 3,720,407 | A * | 3/1973 | Woodward | ..... | 271/161 |
| 4,478,401 | A * | 10/1984 | Shibuya | ..... | 271/22 |
| 4,942,435 | A * | 7/1990 | Kneisel et al. | ..... | 399/393 |
| 5,188,353 | A | 2/1993 | Parks | | |
| 5,261,655 | A | 11/1993 | Keller et al. | | |
| 5,364,087 | A * | 11/1994 | Schieck et al. | ..... | 271/148 |
| 5,409,202 | A | 4/1995 | Naramore et al. | | |
| 5,476,256 | A | 12/1995 | Fortuna et al. | | |
| 5,511,773 | A * | 4/1996 | Burger | ..... | 271/148 |
| 5,570,172 | A | 10/1996 | Acquaviva | | |
| 5,842,695 | A | 12/1998 | McVeigh | | |
| 6,065,745 | A * | 5/2000 | Casper et al. | ..... | 271/160 |
| 6,213,460 | B1 * | 4/2001 | Cahill et al. | ..... | 271/161 |
| 6,283,469 | B1 * | 9/2001 | Weber | ..... | 271/148 |
| 6,386,534 | B1 * | 5/2002 | Woody et al. | ..... | 271/217 |
| 6,443,450 | B1 | 9/2002 | Antinora | | |
| 6,575,461 | B1 | 6/2003 | Rider | | |
| 6,629,693 | B2 * | 10/2003 | Siow et al. | ..... | 271/171 |
| 7,458,574 | B2 * | 12/2008 | Wilcox et al. | ..... | 271/148 |
| 8,177,223 | B2 * | 5/2012 | Bauer et al. | ..... | 271/157 |

* cited by examiner

*Primary Examiner* — Kaitlin Joerger
*Assistant Examiner* — Ernesto Suarez
(74) *Attorney, Agent, or Firm* — Ronald E. Prass, Jr.; Prass LLP

(57) ABSTRACT

This is a stacking tray especially useful in a paper marking system. When papers containing an ID or credit card attached are stacked, an uneven stack results where the card portion is thicker than the paper without the card. This presents a difficult situation for moving the stack onto a transport to a printer or other stations. To correct this uneven or thicker stack from hindering paper feed, two paper plate supports are provided, one a vertically movable plate and the other a fixed plate support. The ID card or credit card portion of the paper is always loaded onto the vertically movable plate thereby providing a substantially flat top stack for easy movement of the sheets from the stack.

10 Claims, 5 Drawing Sheets

CONFORMING PAPER TRAY PLATE FOR LARGE FORMAT PAPERS HAVING ATTACHED ID CARDS

This invention relates to paper feeding stations in marking systems and, more specifically, to a novel stacker assembly used in said stations.

BACKGROUND

While the present invention can be effectively used in a plurality of suitable paper or sheet-handling systems, it will be described for clarity as used in electrostatic marking systems such as electrophotography. In an electrostatographic reproducing apparatus commonly used today, a photoconductive insulating member may be charged to a negative potential and thereafter exposed to a light image of an original document to be reproduced. The exposure discharges the photoconductive insulating surface in exposed or background areas and creates an electrostatic latent image on the member which corresponds to the image areas contained within the original document. Subsequently, the electrostatic latent image on the photoconductive insulating surface is made visible by developing the image with a developing powder referred to in the art as toner. During development, the toner particles are attracted from the carrier particles by the charge pattern of the image areas on the photoconductive insulating area to form a powder image on the photoconductive insulating area. This image may be subsequently transferred or marked onto a support surface such as a copy paper (from a feeding station) to which it may be permanently affixed by heating or by the application of pressure.

As above noted, there are many systems that feed or transport paper or other sheet media to the system before the media is marked or treated. These marking systems could include electrostatic marking systems, non-electrostatic marking systems and printers or any other system where paper or other flexible sheet media or receiving sheets are fed or transported internally to a print engine for marking. The present invention can be used as a stacker before a print engine or before entering a finishing station.

The feeder stacker tray assembly in these marking systems usually comprise a stacker tray, controller sensors and height stack switches. Sheet stacker assemblies are well known in the art such as those disclosed in Xerox Corporation U.S. Pat. Nos. 5,188,353; 5,261,655; 5,409,202; 5,476,256; 5,570,172; 5,842,695; 6,443,450 and 6,575,461. The disclosures of these Xerox Corporation patents are incorporated by reference into this disclosure.

Large format media and paper stack featuring ID cards attached to the main sheet are difficult to load into paper trays in substantial quantities due to build up in the area where the cards are attached. If the location of the cards is not near an edge and is located where standard tiltatron design will not work, the paper stack cannot be easily used. Therefore, cards embossed on paper such as ID cards create an uneven stack due to the thickness of the paper containing the ID card and maintaining a flat upper stack surface needed for proper feeding of the paper. Papers with embossed cards are referred to at Xerox Corporation as DocuCards (a trademark of Xerox Corporation). The term "DocuCards" as used in this disclosure refers to all size paper with embossed cards on their surface.

SUMMARY

This invention provides a flat paper tray plate system for DocuCards. The tray is designed to support the main stack while incorporating a vertically movable plate that supports the ID card (or credit card) portion of the sheet. In one embodiment, the movable portion of the plate is supported by vertical spring-loaded cylinders (similar to cafeteria plate stacks). As the stack is built up (loading the paper tray), the movable plate lowers, compensating for the larger stack height buildup under the ID cards. This allows the entire paper stack top to stay substantially flat and allows a larger number of sheets to be loaded into the feeder paper tray. This design allows for the horizontal feeding of specific DocuCards made up of two cards offset on a carrier sheet. The present invention is very desirable in one embodiment when modularized to allow various placements of the spring cylinders and fixed versus moving sections of the plate in order to accommodate various card configurations.

The present invention utilizes a flat paper tray plate that is designed to support the main stack and incorporates a vertically movable plate that will support the ID card portion of the sheet. As the stack is built up (loading the paper tray), the movable plate will lower, compensating for the faster stack height buildup under the ID cards. This will allow the entire paper stack to stay flat and allow a larger number of sheets to be loaded into the paper tray.

DETAILED DISCUSSION OF DRAWINGS AND PREFERRED EMBODIMENTS

Figure 1:
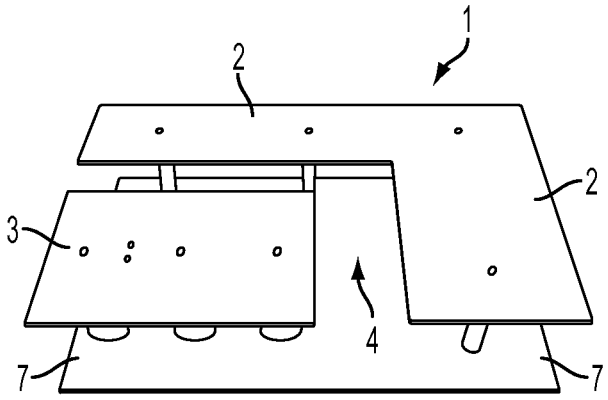
FIG. 1 is a top view of an embodiment of the stacker tray of this invention.
Figure 2:
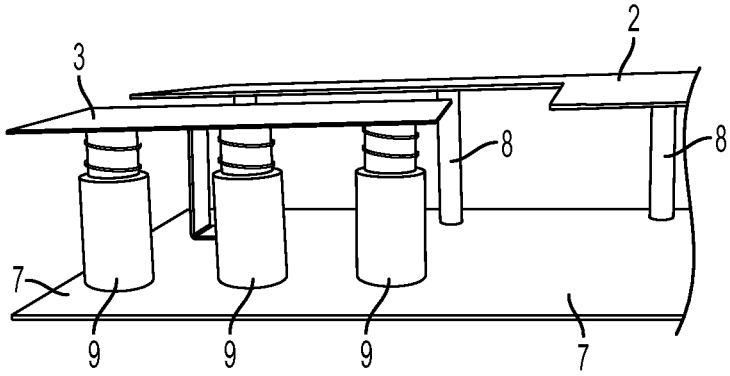
FIG. 2 is a side view of the stacker tray of FIG. 1.

In FIG. 1, a top view and in FIG. 2 a side view, of an embodiment of the stacker tray 1 of this invention where an L-shaped fixed paper support 2 is used and a smaller movable plate 3 is located adjacent the L-shaped fixed support 2 is illustrated. There is a gap 4 between plates 2 and 3. The smaller movable plate 3 when loaded will be located under the ID card portion 5 of the sheets 6. A base support plate 7 supports columns 8 of the fixed plate 2 and vertical spring-loaded cylinders 9 of the smaller movable plate 3. The gap 4 between plates 2 and 3 is needed to allow for transition of the paper between the two levels. When the stacker tray 1 is loaded, the smaller movable plate 3 is always on a plane below the plane of fixed paper support plate 2. FIG. 2 shows them on substantially the same plane when not loaded.

Figure 3:
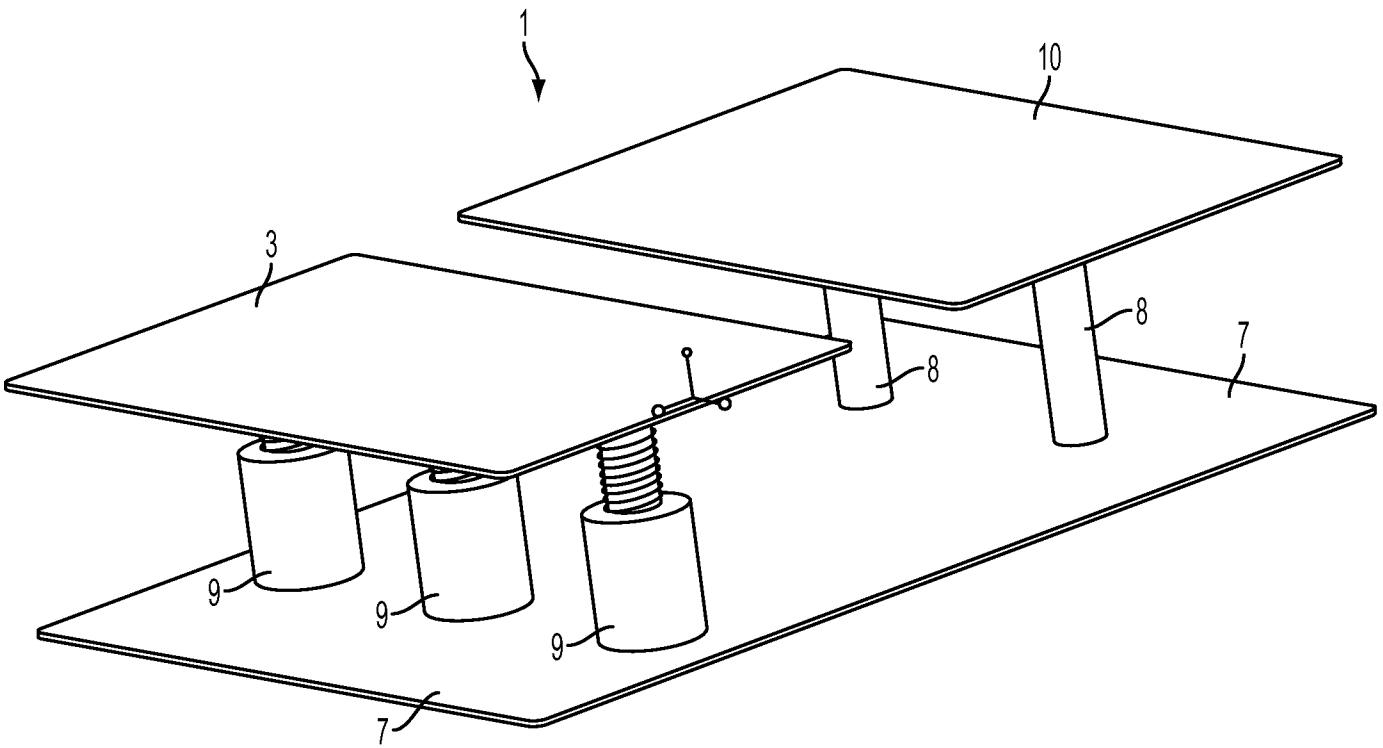
FIG. 3 is a top view of a second embodiment of this invention.
Figure 4:
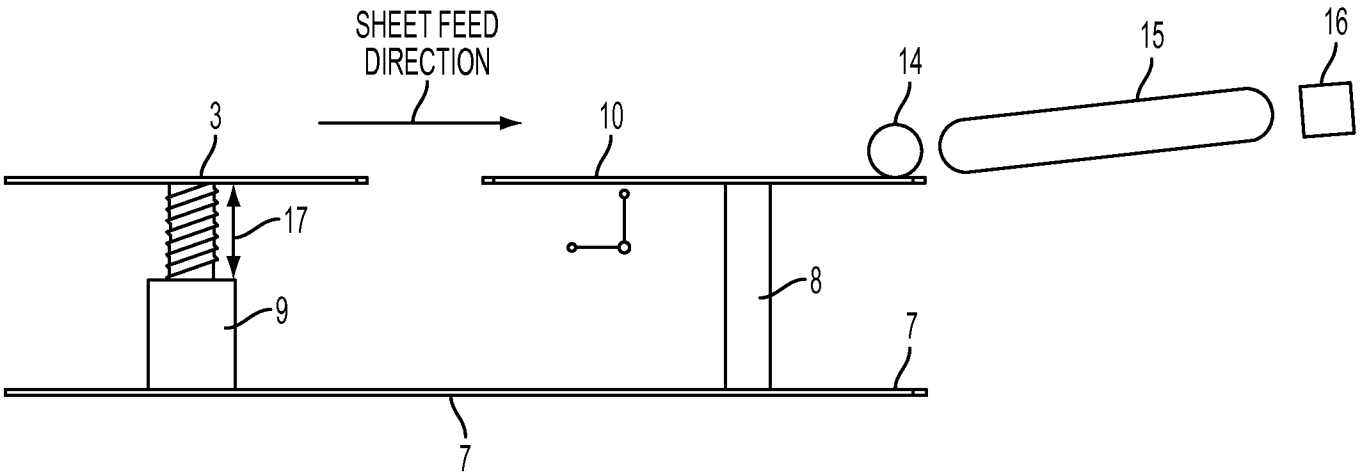
FIG. 4 is a side view of the stacker tray of FIG. 3.

FIG. 3 is a top view of a second embodiment of this invention and FIG. 4 is a side view of FIG. 3 where all components of FIGS. 1 and 2 are the same except in FIGS. 3 and 4 a rectangular fixed plate 10 is used in place of the L-shaped fixed plate 2 of FIGS. 1 and 2. The L-shaped fixed plate of FIGS. 1 and 2 is preferred because in FIG. 4 a takeaway roll 14 moves the top sheet 12 of the stack 6 (see FIG. 6) to a vacuum feed transport 15 for movement to the printer 16 or other station for marking or processing. The paper 6 when loaded on plates 3 and 10 causes the ID card portion 5 load to move the plate 3 downward as shown by arrows 17. Since the plate 3 is spring loaded onto cylinders 9, the heavier weight of the ID card portions 5 will move the plate 3 down to a level below the plane of fixed plate 10 (or plate 2 of FIGS. 1 and 2).

Figure 5:
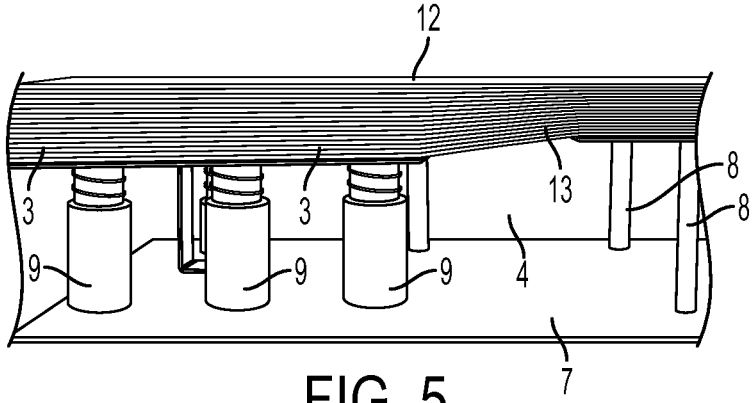
FIG. 5 is a side view of the stacker tray when it is partially loaded with paper.
Figure 6:
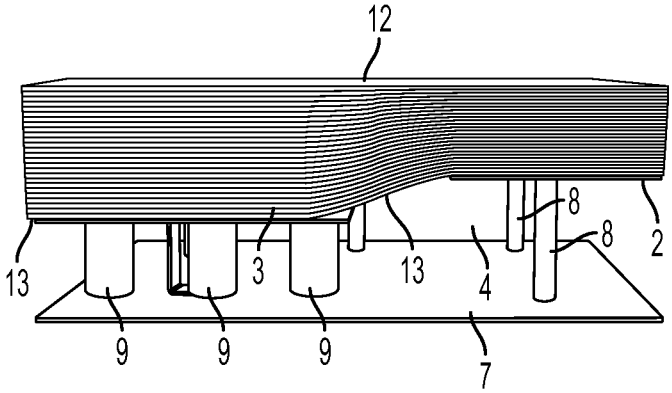
FIG. 6 is a side view of a fully loaded stacker tray of FIG. 5.

In FIG. 5, when the stacking tray 1 is partially loaded with the ID 5 card-sheet 6, the movable plate has started to take a load from the stack 6. As more paper 6 is loaded, the springs 11 will deflect further to reflect the ID cards portion 5 being supported. When the stacking tray 1 is fully loaded as shown in FIG. 6, the top of the stack 12 is substantially horizontal compared to the stack bottom 13. In FIG. 6, the movable plate 3 has lowered to compensate for the added thickness under the ID card portion of the paper stack 6. The paper 6 transitions from the fixed plate 2 to the movable plate 3 utilizing the gap 4. The top of the stack 6 remains substantially horizontal or flat for easy feeding.

Figure 7:
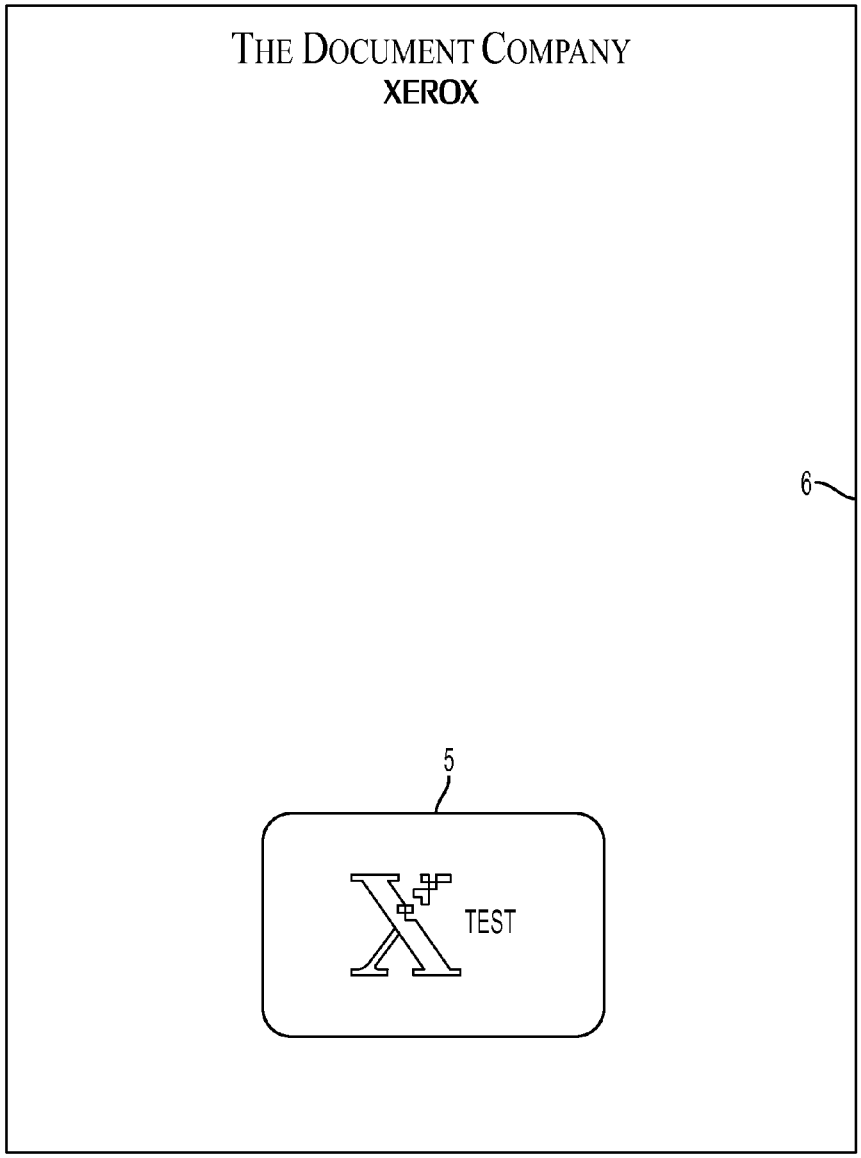
FIG. 7 is a top view of a paper containing an embossed ID card thereon.

In FIG. 7, a sample sheet of DocuCard (sheet with embossed ID card 3) is illustrated by way of illustration not limitation. Any suitable paper with an embossed card or card 5 in any location may be used. The card 5 may be a peel-off card or may be permanently attached to sheet 6.

In summary, this invention provides a paper stacking tray comprising two separated paper supports, one a fixed paper support plate, (conforming plate) and the other a vertically movable support plate. The vertically movable support plate when supporting a paper stack is positioned on a plane below the fixed support plate and is configured to support a section of the paper containing an ID or credit card. The movable support plate is positioned at a location in the stacking tray where the credit card on which said paper will be supported and will rest on the movable support plate on a plane below a remainder of the paper, thereby providing a substantially flat paper top stack portion for easy movement of paper from the stack. In the stacking tray the vertical movable spring loaded cylinders and the vertically movable support plate are configured to lower as a stack of paper is increased thereon. The conforming plate and the vertically movable support plate are configured to be moved to various locations in the stacking tray in order to accommodate various card containing paper configurations.

The stacking tray is modularized to be easily fitted into a feeding station of a marking apparatus. The stacking tray in one embodiment has the fixed support plate which from a top view has an L-shaped configuration. The stacking tray in one embodiment has the fixed support plate which from a top view has a rectangular configuration. The stacking tray is configured wherein both the fixed support plate and the vertically movable support plate are supported on a base support plate. The stacking tray of this invention is configured wherein a number of sheets that can be loaded thereon is increased to about 250 sheets from about 75 sheets of the prior art trays. In the stacking tray, a gap is provided between the fixed paper support plate and the vertically movable support plate. Also provided in this invention is a method in a marking system of stacking papers having an ID or credit card attached thereto which comprises providing in a stacking tray two separated paper supports, one a fixed paper support plate and the other a vertically movable support plate. A stack of the papers is loaded onto the two separated paper supports where the portion of paper holding ID or credit card is loaded onto the vertically movable support plate and the remainder of the paper is stacked onto the fixed paper support plate, thereby providing the stack with a substantially flat top portion for convenient feeding of the papers to a print engine or a further processing station.

It will be appreciated that variations of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A paper stacking tray, comprising;

a fixed paper support plate, the fixed paper support plate from a top view having an L-shaped configuration; and a vertically movable paper support plate comprising a flat upper portion supported by vertically movable spring loaded cylinders, the vertically movable paper support plate, when supporting a paper stack, being positioned on a plane that is positioned below and parallel to a plane of the fixed paper support plate, and being configured to support a section of the paper stack containing an identification card or a credit card, and the vertically movable paper support plate being positioned at a location in the stacking tray where the identification card or the credit card on a sheet of paper is supported on and rests on the movable support plate on a plane below a remainder of the sheet of paper, thereby providing a substantially flat paper top stack portion, legs of the L-shaped configuration of the fixed paper support plate extending along two sides of the vertically movable paper support plate.

2. The paper stacking tray of claim 1, the vertically movable paper support plate being configured to progressively lower as a height of the paper stack increases.

3. The paper stacking tray of claim 1, the fixed paper support plate and the vertically movable paper support plate being configured to be moved to various locations in order to accommodate various identification card or credit card containing paper configurations.

4. The paper stacking tray of claim 1, the paper stacking tray being modularized to fit into an existing feeding station of a marking apparatus.

5. The paper stacking tray of claim 1, both the fixed paper support plate and the vertically movable paper support plate are supported on a base support plate.

6. The paper stacking tray of claim 1, a gap being provided between the fixed paper support plate and the vertically movable paper support plate.

7. A method in a marking system of stacking papers having an identification card or a credit card attached, comprising:

providing in a stacking tray, a fixed paper support plate, the fixed paper support plate from a top view having an L-shaped configuration;

providing in a stacking tray, a vertically movable paper support plate comprising a flat upper portion supported by vertically movable spring loaded cylinders, the vertically movable paper support plate being positioned on a plane that is below and parallel to a plane of the fixed paper support plate, legs of the L-shaped configuration of the fixed paper support plate extending along two sides of the vertically movable paper support plate; and loading a stack of papers onto the two separated paper supports, a portion of a sheet of paper holding the identification card or the credit card being loaded onto the vertically movable paper support plate and a remainder of the sheet of paper being stacked onto the fixed paper support plate, stack of papers being provided with a substantially flat top portion for feeding of each sheet of paper to a print engine or to a further processing station.

8. The method of claim 7, the vertically movable paper support plate being configured to lower as a height of the stack of papers increases.

9. The method of claim 7, the stacking tray being modularized to fit into an existing feeding station of a marking station.

10. The method of claim 7, the portion of paper holding the identification card or the credit card always being positioned to be loaded onto the vertically movable paper support plate.

* * * * *